US005570855A

United States Patent [19]

Aihara

[11] Patent Number: 5,570,855

[45] Date of Patent: Nov. 5, 1996

[54] SHEET FEEDER FOR FEEDING PREDETERMINED LENGTHS OF SHEET FROM A LONG ROLL OF SHEET

[76] Inventor: Shigeichiro Aihara, 8-10-2, Nishigotanda, Shinagawa-ku, Tokyo, Japan

[21] Appl. No.: 404,337

[22] Filed: Mar. 15, 1995

[30] Foreign Application Priority Data

Mar. 15, 1994 [JP] Japan ..... 6-043410

[51] Int. Cl.[6] ..... B65H 16/00; A47K 10/00

[52] U.S. Cl. ..... 242/565

[58] Field of Search ..... 242/563.2, 565

[56] References Cited

U.S. PATENT DOCUMENTS

| | | | |
|---|---|---|---|
| 2,691,561 | 10/1954 | Birr | 242/565 |
| 2,825,513 | 3/1958 | Yerrid et al. | 242/563.2 |
| 3,408,125 | 10/1968 | Rasmussen | 242/565 |
| 3,734,586 | 5/1973 | Schnyder | 242/565 |
| 5,135,179 | 8/1992 | Morand | 242/565 |

FOREIGN PATENT DOCUMENTS

| | | | |
|---|---|---|---|
| 2922581 | 1/1980 | Germany | 242/565 |

*Primary Examiner*—Daniel P. Stodola
*Assistant Examiner*—Matthew A. Kaness
*Attorney, Agent, or Firm*—Ostrolenk, Faber, Gerb & Soffen, LLP

[57] ABSTRACT

A sheet feeder for feeding a long sheet wound in the form of a roll as cut sheets having a predetermined length, comprises a housing and a pull length regulator being attached to the housing, for stopping the running of the long sheet when the sheet has been pulled by a predetermined length.

17 Claims, 3 Drawing Sheets

SHEET FEEDER FOR FEEDING PREDETERMINED LENGTHS OF SHEET FROM A LONG ROLL OF SHEET

BACKGROUND OF THE INVENTION

This invention relates to sheet feeders for feeding sheets, such as paper towels used for toilets, kitchens, etc. and polyethylene bags in super-markets.

Most paper towel feeders used today dispense paper towels which are precut to a uniform length.

In such a sheet feeder, however, paper towels are accommodated in a folded state. The quantity of paper towels that are accommodated is small, and frequent replenishment required. Because special cut paper towels are used, the cost is high.

In view of these problems, a roll paper towel feeder is proposed, in which an long paper sheet wound in the form of a roll is cut to a suitable length whenever it is fed for use.

This paper feeder has features such that the quantity of paper that can be accommodated can increase greatly compared to the case where folded paper is used, that the replenishment with paper may be made by a reduced number of times, and that the paper that is used is inexpensive in cost. However, it is difficult to cut the supplied paper to a uniform length. One possibility is to provide precut incisions at, for example, every several tens of centimeters. By so doing, however, paper may, in many cases, be pulled irrespective of the incisions positions. This leads to the use of more paper than a prescribed quantity, thus resulting in early consumption of paper and leading to increased cost.

To solve this problem, one might provide a load to make it difficult to pull the paper. Paper towels, however, are usually handled with a wet hand, and therefore, it is likely that a leading end portion of the towel will be broken apart from the rest of the towel.

SUMMARY OF THE INVENTION

It is an object of the invention is to provide a sheet feeder, which can feed sheets having a uniform length.

A further object of the invention is to provide a sheet feeder, which permits avoiding the waste of sheets and consumption saving thereof.

A further object of the invention is to provide a sheet feeder, which has satisfactory operation control property of sheet pulling.

The above objects of the invention are achieved by a sheet feeder for feeding a long sheet wound in the form of a roll as cut sheets having a predetermined length, which a housing; and a pull length regulating means being attached to the housing, for stopping the running of the long sheet when the sheet has been pulled by a predetermined length.

The pull length regulating means may comprises:

a rotor brought into contact with the long sheet at a position in a predetermined course of said long sheet running and rotated based on the action of the friction between the long sheet and the rotor; and a rotation regulating means for regulating the rotation of the rotor.

Preferably, the rotor rests on the running long sheet such that its weight acts on the long sheet.

Preferably, the rotation regulating means comprises:

a movable member disposed on an end of the rotor;

a hook portion provided on said movable member; and a hookable portion provided on the rotor in correspondence to the hook portion.

Preferably, the hook portion is a projection, while the hookable portion is a recess capable of being engaged by the projection.

According to another aspect of the invention, the sheet feeder further comprises:

a biasing means serving, when the rotor is moved upward by a tension acting on the long sheet, to cause displacement of the movable member by a predetermined angle in the opposite direction to the direction of rotation of the rotor lest the hook should hook the hookable portion;

after substantially one rotation of the rotor with the running of said long sheet, the hook portion having been displaced by the biasing means hooks the hookable portion to stop the rotation of the rotor.

Preferably, the rotor is a cylindrical member having an inner diameter of $r_1$ and the shaft has an outer diameter of $r_2$ ($r_1>r_2$), the shaft; being inserted in a center hole of the cylindrical member.

Preferably the movable member is a cylindrical member having an inner diameter of $r_3$; and the level of the axis of the cylindrical member with the inner diameter of $r_3$ is set to be higher than the level of the axis of the cylindrical member with the inner diameter of $r_1$.

Preferably, the movable member is a cylindrical member having an inner diameter of $r_3$; and a shaft having an outer diameter of $r_2$ ($r_3>r_2$) being inserted in the central hole of said cylindrical member, the level of the axis of the cylindrical member with the inner diameter of $r_3$ being set to be higher than the level of the axis of the shaft with the inner diameter of $r_2$.

Preferably, the movable member is a cylindrical member having an inner diameter of $r_3$;

a shaft having an outer diameter $r_2$ ($r_3>r_2$) being inserted in the central hole of the cylindrical member, a spacer being provided between the cylindrical member and the shaft, the level of the axis of the cylindrical member with the inner diameter of $r_3$ being set to be higher than the level of the axis of the shaft.

Preferably, the spacer provided between the cylindrical member and the shaft is a spring member.

Preferably, the movable member has a convexity formed on the outer side;

the convexity being provided such that it is loosely fitted with a groove such as to define a range of displacement of the movable member.

According to another aspect of the invention, the sheet feeder suitably further comprises a braking means for braking the sheet to prevent idling thereof by a pull force applied to the long sheet. Particularly, the braking means is constituted by pair rollers for pinching the long sheet there between to thereby apply a braking force to the long sheet.

According to the invention, the sheet feeder suitably further comprises a guide roller disposed between the rotor and a pull outlet and at a level higher than the level of the axis of the rotor.

Preferably, a rubber member is provided on the outer periphery of the rotor.

The sheet feeder according to the invention has pull length regulating means such that sheets having a uniform length can be supplied at all times, there being no possibility of pull of sheet beyond a prescribed length. Thus, it is possible to effectively prevent the waste of sheet and permit great saving thereof.

Besides, since the sheet is adapted to be stopped automatically when it is pulled by a predetermined length, there is no need of holding the sheet under great load. Thus, the sheet can be pulled without need of great force, and it is not broken apart even by pulling it with a wet hand. It is thus possible to readily pull the sheet.

BRIEF DESCRIPTION OF THE DRAWINGS

The above and other objects, features and advantages of the invention will become more apparent when the detailed description of the preferred embodiment of the invention is read with reference to the accompanying drawings, in which.

DETAILED DESCRIPTION OF THE PREFERRED EMBODIMENT

Figure 1:
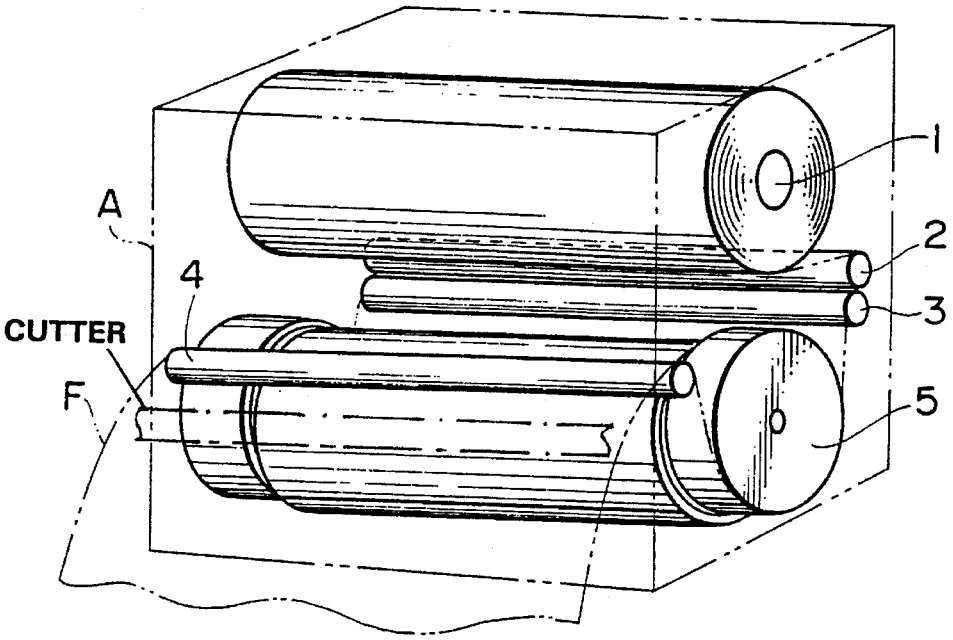
FIG. 1 is a perspective view showing substantially the internal structure of a paper feeder (i.e., sheet feeder)

Referring now to the drawings wherein like numerals indicate like elements, there is shown in FIGS. 1 to 8 show an embodiment of paper feeder (i.e., sheet feeder) according to the present invention. As best shown in FIG. 1, a long roll of paper F is accommodated on a feed roller 1 in a case A. The paper F is passed between guide rollers 2 and 3 which face one another, causing the paper F to change in direction from the horizontal to vertical. Subsequently, the paper F is fed to a pull length regulation mechanism 5 described below.

After passing through the pull length regulation mechanisms, the direct of the paper F is changed by the guide roller 4 from the vertical to the horizontal. The guide roller 4 is provided at a level above the level of the axis of rotation of a cylindrical member in the pull length regulation mechanisms, and the paper F is thus pulled to the outside from a level position above the axis of rotation of the cylindrical member.

Figure 2:
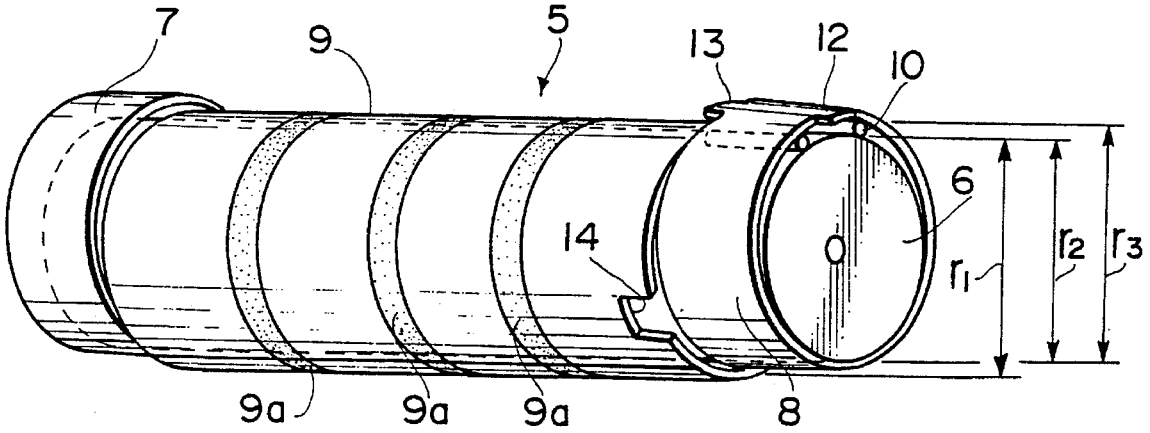
FIG. 2 is a perspective view showing a pull length regulation mechanism.

The guide rollers 2 and 3 are provided such that they pinch the paper F. The pinching force is adjusted to provide a predetermined braking force to the paper F. As shown in FIG. 2, the pull length regulation mechanism 5 includes a cylindrical shaft 6 (having an outer diameter of r2), a stationary ring 7 having an inner diameter r3 slightly greater than the outer diameter r2 of the shaft 6, a movable ring 8 (movable member) having an inner diameter of r3, and a cylindrical member 9 (rotor) having an inner diameter r1 (r1=r3) and rotatable about the shaft 6.

The stationary and movable rings 7 and 8, respectively, have outer peripheries which are smooth and less subject to friction. The outer periphery of the cylindrical member 9, on the other hand, is provided circumferentially with a rubber member 9*a* having a large coefficient of friction to prevent slippage with respect to the paper F.

Figure 3:
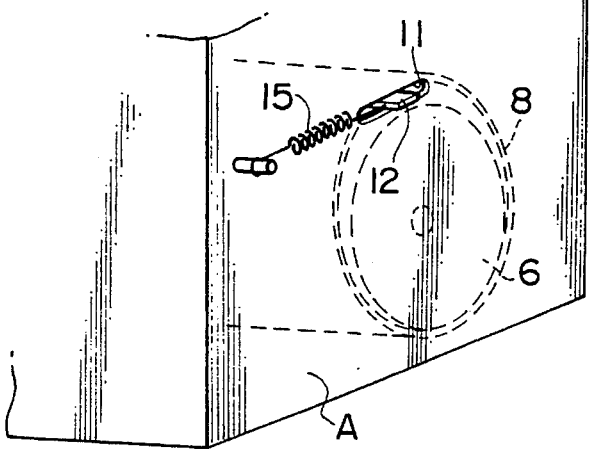
FIG. 3 is a perspective view showing a relation between a groove and a convexity.

The shaft 6 and stationary ring 7 are secured to the case A. A spacer 10, for example a leaf spring is provided between the movable ring 8 and shaft 6, for biasing the axis of the movable ring 8 to a position above the axis of the shaft 6. The movable ring 8 is rotatable about the shaft 6 by a slight angle. The movable ring 8 has a projection 12. As shown in FIG. 3, the projection 12 is loosely fitted in a long groove 11 provided in the case A. The movable ring 8 can be revolved in the range defined by groove 11.

As shown in FIG. 2, the cylindrical member 9 is usually in a position slightly lower than that of the stationary and movable rings 7 and 8, respectively.

A projection (hook portion) 13, having a width of $l_1$ (FIG. 6) is provided on the inner end of the movable ring 8. The cylindrical member 9 is formed with a notch 14 (hookable portion) having a width $l_2$ ($l_2>l_1$).

A spring (biasing means) 15 is stretched between the case A and the projection 12. The movable ring 8 is biased by the spring 15 such to rotate in a direction opposite to the direction of rotation of the cylindrical member 9, i.e., toward a paper outlet. Correspondingly, the projection 13 is tilted slightly from the overhead position toward the paper outlet.

Figure 4:
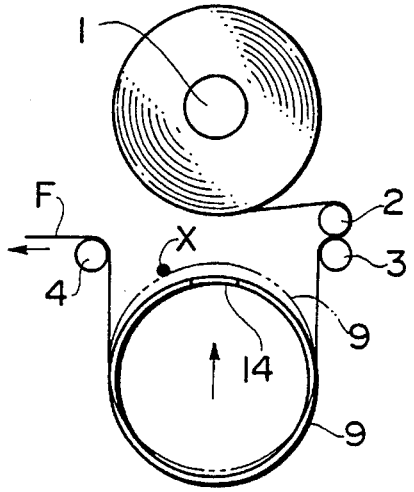
FIG. 4 is a side view showing the operating status of the system.

In the system having the above structure, before a tensive force is applied to the paper F, the cylindrical member 9 and moveable ring 8 are in the position illustrated in FIG. 4. The projection 13 (at location x) and the notch 14 are not aligned. Additionally, the cylindrical member 9 is in a position lower than the stationary and movable rings 7 and 8 when the paper is pulled taut, the cylinder and member 9 are raised by the paper F being to a level shown by the phantom line. As a result, the cylindrical member 9 is brought to be substantially at the same level as the stationary and movable rings 7 and 8.

In this state, the projection 13 of the movable ring 8 moves to a position abutting the outer surface of the cylindrical member 9 of the notch 14 of the cylindrical member 9, i.e., on the side of the paper outlet (as shown at point X). Thus, the projection 13 is not located in the notch 14 when the cylindrical member 9 is initially raised by the paper F.

When the paper F is pulled, the cylindrical member 9 is rotated clockwise as viewed in FIG. 1 with its outer surface in contact with the projection 13 of the movable ring 8.

Figure 5:
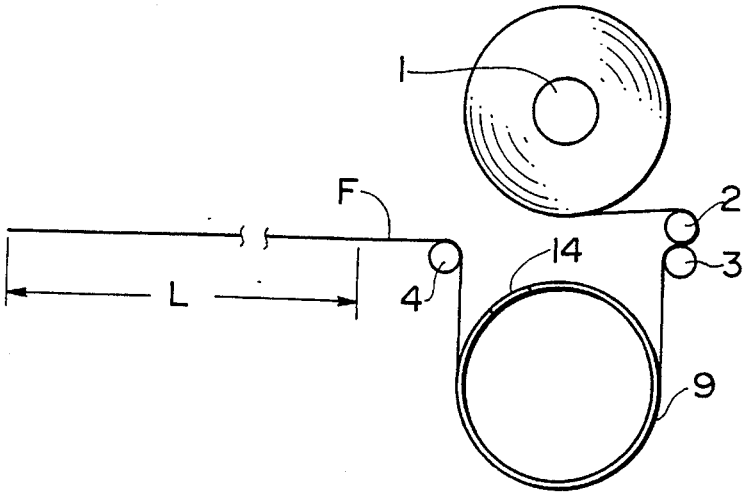
FIG. 5 is a side view showing another operating status of the system.
Figure 6:
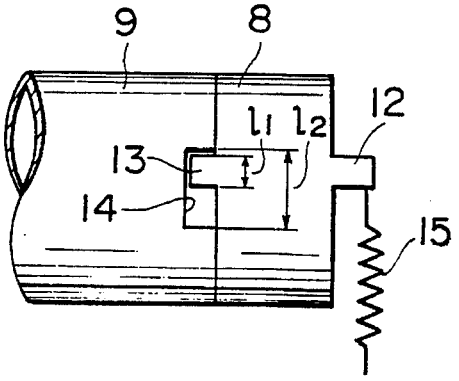
FIG. 6 is a plan view showing an operating status of the system.
Figure 7:
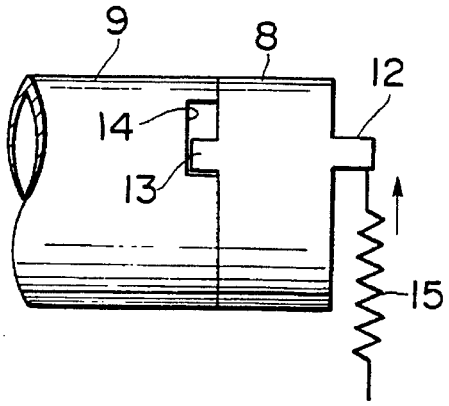
FIG. 7 is a plan view showing another operating status of the system.

When the paper F has been pulled by a length L corresponding to the circumference of the cylindrical member 9, as shown in FIG. 5, the cylindrical member 9 has completed substantially one rotation. At this time, the notch 14 reaches the position of the projection 13. Consequently, the projection 13 moves into the notch 14, as shown in FIG. 6 as the paper F is pulled further, the cylindrical member 9 rotates relative to the ring 8 until the projection 13 initially engages the opposite end of the notch 14. Thereafter, the cylindrical member 9 and the ring 8 move as a unit and the movable ring 8 is rotated slightly against the elasticity of the spring 15. Subsequently, the projection 12 is brought into contact with the end face of the groove 11, thus stopping rotation of the movable ring 8. As a result as shown in FIG. 7, the cylindrical member 9 can no longer rotate with the projection 13 in contact with the other end face of the notch 14.

Now, the paper F can not be pulled further. In this state, the paper F can be cut by applying it to the cutter provided at the outlet of case A and pulling it with a force applied thereto.

As a result, it is possible to obtain paper towels cut to a uniform length.

If paper with incisions is used, there is no need of providing an outlet cutter. That is, by strongly pulling the paper F after the paper F has become incapable of being pulled further, the pulled part of paper is cut apart at the incisions.

Figure 8:
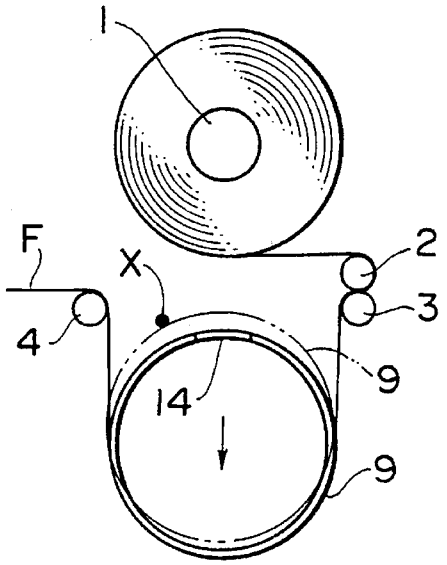
FIG. 8 is a side view showing a further operating status of the system.

When the paper F is cut apart, the tension in the paper is released. As a result, the cylindrical member 9, as shown in FIG. 8, falls under the force of gravity from the position shown by phantom line to its initial position and the projection no longer engages notch 14.

Since the system is constructed such that the cylindrical member 9 is moved not in the vertical direction but in the horizontal direction, the cylindrical member 9 may be biased by a spring in the horizontal direction. By so doing, it is possible to obtain an operation similar to that described above.

After the paper F has been cut and the cylindrical member 9 returned to its lower position, the projection 13 of the movable ring 8 is pulled back to the initial position (i.e., point X) by the tension of the spring so that it is no longer aligned with the notch 14. Thus, when the paper F is subsequently pulled, the cylindrical member 9 is freely rotated without engagement of the projection 13 of the movable ring 8 in the notch 14. Thus, it is possible to again pull a length of paper F corresponding to one rotation of the cylindrical member 9.

As has been described above, with the above embodiment of the paper feeder described it is possible to pull the paper by a uniform length.

Further, the operation of the device is simple and paper is saved.

Furthermore, its structure is simple and comprises a small number of parts, so that it is less subject to troubles.

Further more, it is easy to replenish the paper.

Further more, the paper feeder can be manufactured at low cost and thus can be provided inexpensively.

While in the above description the sheet feeder is a paper towel feeder to be installed in a toilet, the invention is applicable to any other paper feeder. For example, the invention is applicable to a kitchen towel feeder used in the kitchen or to the supply of polyethylene bags consumed in supermarkets.

Further, the invention can be utilized as facsimile or printing sheet feeders. In these cases, a pull length control using complicated mechanisms controlled by a computer is unnecessary, thus permitting great simplification of the system.

According to the invention, it is possible to feed sheets having a uniform length, avoid waste of the sheet and permit ready pulling of the sheet.

What is claimed is:

1. A sheet feeder for feeding a sheet wound in the form of a roll, said sheet feeder comprising:

(A) a housing;

(B) a sheet feeding path defined in said housing for causing said sheet to move through said housing along a desired path when a free end of said sheet is pulled out of said housing; and (C) a pull length regulator stopping the running of said sheet when it has been pulled out of said housing by a predetermined length, said pull length regulator including:

(1) a rotor adapted to rest on said sheet as said sheet moves along said desired path such that the weight of said rotor would act on said sheet, said rotor rotating in response to the movement of said sheet due to friction between said sheet and said rotor; and (2) a rotation regulator regulating the rotation of said rotor.

2. The sheet feeder of claim 1, wherein:

said rotor is a cylindrical member having an inner diameter of $r_1$ and rides on a shaft having an outer diameter of $r_2$ which is less than $r_1$ and which is located in a center hole of said cylindrical member.

3. The sheet feeder of claim 1, which further comprises a brake for applying a predetermined braking force to said sheet.

4. The sheet feeder of claim 3, wherein said brake comprises a pair of rollers for pinching said sheet therebetween to thereby apply said braking force to said long sheet.

5. The sheet feeder of claim 1, which further comprises a guide roller disposed between said rotor and an outlet of said housing through which said free end of said sheet may be pulled, said guide roller being at a level which is higher than said level of the axis of said rotor.

6. The sheet feeder of claim 1, wherein a rubber member is provided on the outer periphery of said rotor.

7. A sheet feeder for feeding a sheet wound in the form of a roll, said sheet feeder comprising:

(A) a housing;

(B) a sheet feeding path defined in said housing for causing said sheet to move through said housing along a desired path when a free end of said sheet is pulled out of said housing; and (C) a pull length regulator stopping the running of said sheet when said sheet has been pulled out of said housing by a predetermined length, said pull length regulator including:

(1) a rotor adapted to contact said sheet as it moves along said desired path, said rotor rotating in response to the movement of said sheet due to friction between said sheet and said rotor; and (2) a rotation regulator regulating the rotation of said rotor, said rotation regulator, comprising:

(a) a movable member disposed at an end of said rotor;

(b) a hook portion provided on said movable member; and (c) a hookable portion provided on said rotor in correspondence to said hook portion.

8. The sheet feeder of claim 7 wherein said rotation regulator operates when a tensive force is applied to said sheet as it is pulled out of said housing and said hook portion engages said hookable portion when said predetermined length of sheet has been pulled out of said housing and said tensive force is still applied to said sheet.

9. The sheet feeder of claim 8, further including biasing means for causing said movable member to rotate relative to said rotor when said tensive force is released so as to cause said hook portion and said hookable portion to move out of alignment.

10. The sheet feeder of claim 7, wherein said hook portion is a projection, and said hookable portion is a recess capable of being engaged by said projection.

11. The sheet feeder of claim 7, wherein:

said rotor is a first cylindrical member having an inner diameter of $r_1$;

said movable member is a second cylindrical member having an inner diameter of $r_3$; and the level of the axis of said second cylindrical member is higher than the level of the axis of said first cylindrical member.

a shaft having an outer diameter of $r_2$ which is less than $r_1$ and which is located in a center hole of said cylindrical member.

12. The sheet feeder of claim 7, wherein:

said movable member is a cylindrical member having an inner diameter of $r_3$ which rotates on a shaft having an outer diameter of $r_2$ which is less than $r_3$ and which is located in a central hole of said cylindrical member, the level of the axis of said cylindrical member being higher than the level of the axis of said shaft.

13. The sheet feeder of claim 7, wherein:

said movable member is a cylindrical member having an inner diameter of $r_3$ and riding on a shaft having an outer diameter $r_2$ which is less than $r_3$, and which is inserted in a central hole of said cylindrical member; and a spacer is provided between said cylindrical member and said shaft, the level of the axis of said cylindrical member being higher than the level of the axis of said shaft.

14. The sheet feeder of claim 13, wherein said spacer is a spring member.

15. The sheet feeder of claim 7, wherein:

said movable member has a projection formed on its outer side;

said projection being provided such that it is loosely fitted with a groove formed in a plate member, said groove defining a range of displacement of said movable member.

16. The sheet feeder of claim 7, wherein:

said rotor comprises a first cylindrical member having an inner diameter of $r_1$ which rotates on and a shaft having an outer diameter of $r_2$ which is less than $r_1$, and which is inserted in a center hole of said cylindrical member;

said movable member comprises a second cylindrical member having an inner diameter of $r_3$; and said shaft is inserted in the center hole of said second cylindrical member and the level of the axis of said second cylindrical member is higher than the level of the axis of said first cylindrical member.

17. The sheet feeder of claim 16, wherein a spacer is provided between said second cylindrical member and said shaft, the level of the axis of said second cylindrical member is higher than the level of the axis of said shaft.

* * * * *